United States Patent [19]

Bloxham

[11] 4,276,849

[45] Jul. 7, 1981

[54] BALLAST CONTROL SYSTEM FOR SUBMERSIBLE VESSEL

[76] Inventor: Roger W. Bloxham, P.O. Box 304, Trabuco Canyon, Calif. 92678

[21] Appl. No.: 82,231

[22] Filed: Oct. 5, 1979

Related U.S. Application Data

[63] Continuation-in-part of Ser. No. 933,591, Aug. 14, 1978, which is a continuation-in-part of Ser. No. 889,454, Mar. 23, 1978, abandoned, which is a continuation-in-part of Ser. No. 847,341, Oct. 31, 1977, abandoned.

[51] Int. Cl.[3] ..... B63B 43/06

[52] U.S. Cl. ..... 114/125; 114/260; 114/45

[58] Field of Search ..... 114/44, 45, 121, 125, 114/260, 259

[56] References Cited

U.S. PATENT DOCUMENTS

| | | | |
|---|---|---|---|
| 903,598 | 11/1908 | Mehlhorn et al. | 114/45 |
| 984,133 | 2/1911 | Giese | 114/45 |
| 3,797,440 | 3/1974 | Pangalila | 114/125 |
| 3,886,886 | 6/1975 | Anders | 114/125 |

*Primary Examiner*—Trygve M. Blix

*Assistant Examiner*—Jesus D. Sotelo

*Attorney, Agent, or Firm*—Knobbe, Martens, Olson, Hubbard & Bear

[57] ABSTRACT

A submersible vessel, such as a barge, has a plurality of ballast compartments, each of which communicates with the exterior of the vessel through a separate riser, each terminating in an elongate vertical opening in the hull of the vessel. A vertically movable gate is positioned over said openings. At its uppermost limit of travel, the gate provides a conduit into the bottom portion of said openings so that water may be drawn into the ballast compartments through the risers in response to suction applied to the ballast compartments, thereby submerging the vessel. To raise the vessel, the gate is lowered to uncover the uppermost portion of said openings. Positive air pressure is applied to the ballast compartments to move the water upwardly through the risers and out of the vessel over the top of the gate. The gate is lowered as the ballast compartments are emptied, thereby effectively reducing the heights of the risers as the water level in the ballast compartments descends, so that a constant, low pressure can be used for de-watering. With such a riser and gate system at each corner of the vessel, self leveling during the raising process can be achieved by proper positioning of the gates.

18 Claims, 7 Drawing Figures

10
12
14
16
18
20
22
24
30

14
16
30
32
34
36
38
40
42
44
46
48
50
52
54

Fig. 3
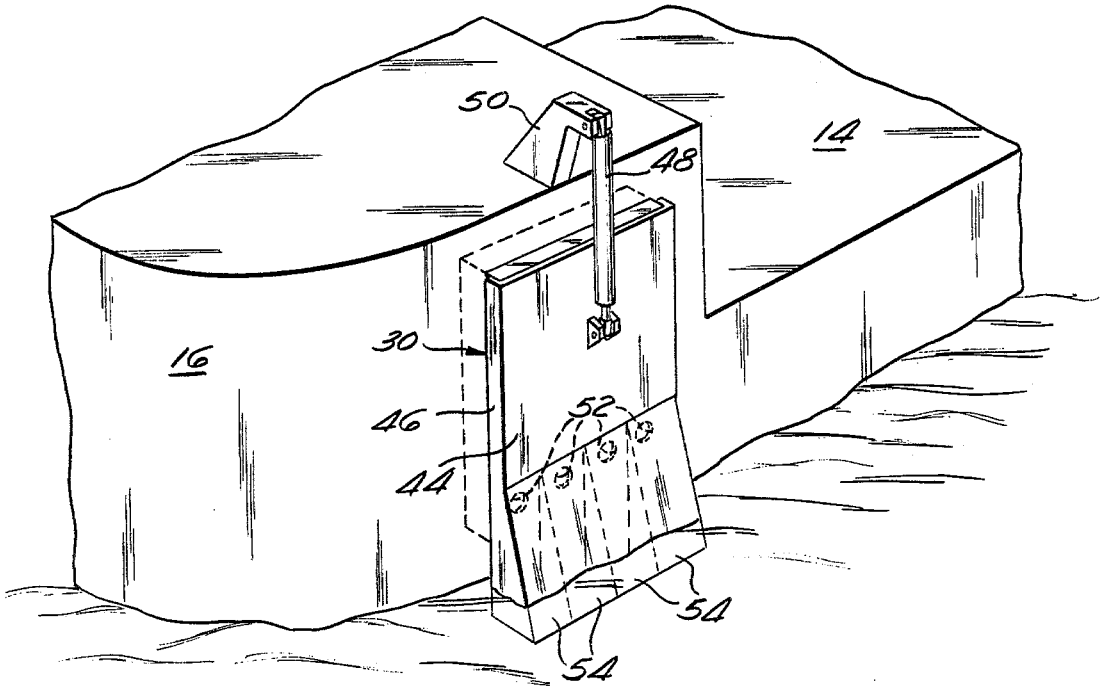
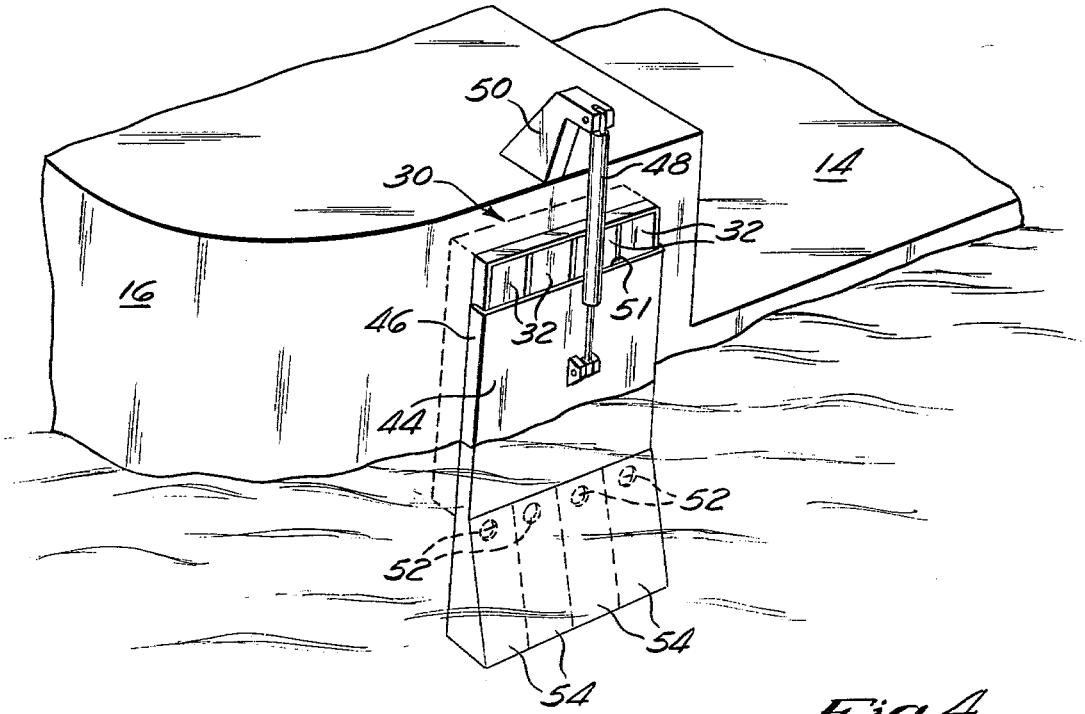
Fig. 4

BALLAST CONTROL SYSTEM FOR SUBMERSIBLE VESSEL

CROSS REFERENCE TO RELATED APPLICATIONS

This application is a continuation-in-part of co-pending Application Ser. No. 933,591, filed Aug. 14, 1978, which is a continuation-in-part of Application Ser. No. 889,454, filed Mar. 23, 1978, now abandoned, which is a continuation-in-part of Application Ser. No. 847,341, filed Oct. 31, 1977, now abandoned.

BACKGROUND OF THE INVENTION

The present invention relates to the field of submersible cargo vessels, and in particular it relates to a self-leveling ballast control system for vessels such as submersible barges and dry docks.

The use of submersible barges to transport cargo such as marine dredging equipment is becoming increasingly popular. Typically, the loading and unloading of such barges is accomplished by controllably submerging one end of the barge and floating cargo on or off. This controlled submergence, which is accomplished by controllably flooding one or more ballast compartments in the barge hull, is a delicate process, since both longitudinal and lateral stability must be maintained. Furthermore, the danger of having the barge go vertical due to errors in flooding control, is ever present.

Likewise, the raising of the barge, especially when the cargo has been loaded thereon, is an operation which requires a great deal of care to avoid instabilities which can capsize the vessel. Thus, the proper positioning and securing of the cargo is crucial, as is the requirement for maintaining the barge in a proper attitude in all directions while it is being raised.

Therefore, in view of the extreme care required during the loading and unloading of such barges, the complete cycle of submerging the barge, loading or unloading the cargo, and raising the barge typically requires at least six hours, and it is not unusual for the whole process to take an entire day or more.

Accordingly, the need has been felt for a submersible barge which can be quickly and safely submerged and raised with a high degree of stability. In my co-pending application, Ser. No. 933,591, filed Aug. 14, 1978, I disclose a submersible, floating vessel which can be submerged and raised quickly, and which is self-leveling during the raising process. However, it would be advantageous to provide a system with which existing barges and the like can be retrofitted to achieve the same results.

SUMMARY OF THE INVENTION

Broadly, the present invention is a pneumatically-operated ballast control system for a submersible vessel in which flooding is accomplished by applying a negative air pressure to the ballast tanks, and in which dewatering is accomplished by the application of a constant, relatively low-level positive pressure to the ballast tanks to evacuate the water through risers which are disposed so as to evacuate water more quickly from the more deeply submerged ballast tanks than from those which are less deeply submerged, in response to the predetermined positive air pressure, so that the vessel is automatically leveled while it is being raised.

In accordance with this concept, a submersible vessel of the type having a hull divided into a plurality of ballast tanks or compartments is used. Each of the tanks or compartments is served by an air conduit communicating with a reversible air pump which selectively pumps air into and out of the individual compartments at a predetermined positive and negative pressures. Each of the compartments communicates by a pipe with a fixed-height riser located in the corner of the vessel nearest the compartment. The outlet of each riser communicates with an elongate vertical outlet opening in the hull, and the outlet openings in each corner of the hull are covered by a hydraulically-actuated gate, which can be moved downwardly to uncover a portion of the outlet openings near the top thereof to permit the expulsion of water. Because the gates can be moved vertically between selected extremes of travel to uncover varying portions of the outlet openings, each of the elongate outlet openings constitutes, in essence, a height-adjustable riser.

To submerge the vessel, the gates are positioned at their uppermost extremes of travel so as to completely close the elongate openings. With the gates in this position, inlet ports in the gates register with inlet-ports in the hull located above the loaded water line of the vessel. Conduits extend from the inlet ports in the gate to below the surface of the water, while the inlet ports in the hull communicate with the aforementioned risers. In response to the application of a negative air pressure from the air pump to the ballast tanks, water is drawn in through the refrigerating inlet ports, down through the riser, and ultimately into the ballast compartments, until the deck of the vessel is submerged to the desired depth.

Dewatering of the vessel to raise it is accomplished by applying a predetermined positive pressure to the ballast compartments. The air pressure forces the water out of the compartments up through the fixed height risers and into the variable height risers, which have been partially opened at the top to provide a water outlet by lowering the hydraulic gates.

By selecting the proper height for the top of the gate ("threshold height"), the effective height of the height-adjustable risers above the surface of the water in the ballast compartments can be adjusted so that the air pressure delivered to the ballast compartments by the air pump will be sufficient to lift the water through the risers to a height which is above the threshold height offered by the top of the gate, thereby expelling the water through the opened portions of the elongate openings. Since it is known that the air of a given pressure will lift a given head of water, the required threshold height above the surface of the water in the ballast compartments can easily be determined for any given preselected air pressure delivered to the ballast tanks.

The tops of the four gates will at all times be above the actual water line of the vessel, and each gate will be on the same level as the other gates in relation to the hull. As the vessel is raised, the actual waterline will descend down the hull. Simultaneously, the water level in the ballast tanks will be lowered, as water is evacuated. In order to provide a constant water head differential between the level of water in the ballast tanks and the threshold height, the threshold height is lowered by moving the gates downwardly in unison, as the vessel is raised. This feature allows a much lower pressure to be used than that which would be necessary if the threshold height remained constant, as the pressure would then have to be sufficient to lift water from the bottom of the ballast tanks to the tops of the gates.

Automatic leveling of the vessel is accomplished during the dewatering process by means of the head differentials which are set up between the outlets at different corners of the vessel when the vessel is canted or tilted. Thus, when the gates at each corner of the vessel are lowered the same amount to provide risers of equal height at all corners of the vessel, those risers in the more deeply submerged portions of the vessel will contain a column of water of greater height than will the risers in the less deeply submerged portions of the vessel. Therefore, the water contained in the risers in the more deeply submerged portions of the vessel needs to be raised a lesser height to be evacuated than does the water in the risers in the less deeply submerged portions of the vessel, so that in response to the application of an equal positive air pressure to the columns of water in each of the risers, the water in the more deeply submerged portions of the vessel will be evacuated more quickly than will the water in the less deeply submerged portions until the vessel assumes a substantially level attitude.

The self-leveling ability of the vessel provides an extremely high degree of stability during loading and unloading. Moreover, this self-leveling ability is accomplished without the complex air and water valving systems of the prior art, the only controls being the switching of the air pump between negative and positive pressure, and the adjustment of the hydraulic gates. Furthermore, the extreme simplicity of operation, coupled with the high degree of stability obtained by the vessel, allows for loading and unloading times which are a fraction of those experienced with the prior art vessels, while at the same time establishing a degree of safety heretofore thought to be unattainable.

While a ballast control system in accordance with the present invention may be incorporated into a vessel as the vessel is being built, it will be appreciated that the system can be readily adapted for retrofitting an exising submersible vessel.

BRIEF DESCRIPTION OF THE DRAWINGS

FIG. 3 is a perspective view of the water inlet and outlet mechanism in position for submerging the vessel;

FIG. 4 is a perspective view of the water inlet and outlet mechanism in position for dewatering the vessel during the raising operation;

DETAILED DESCRIPTION OF THE INVENTION

Figure 1:
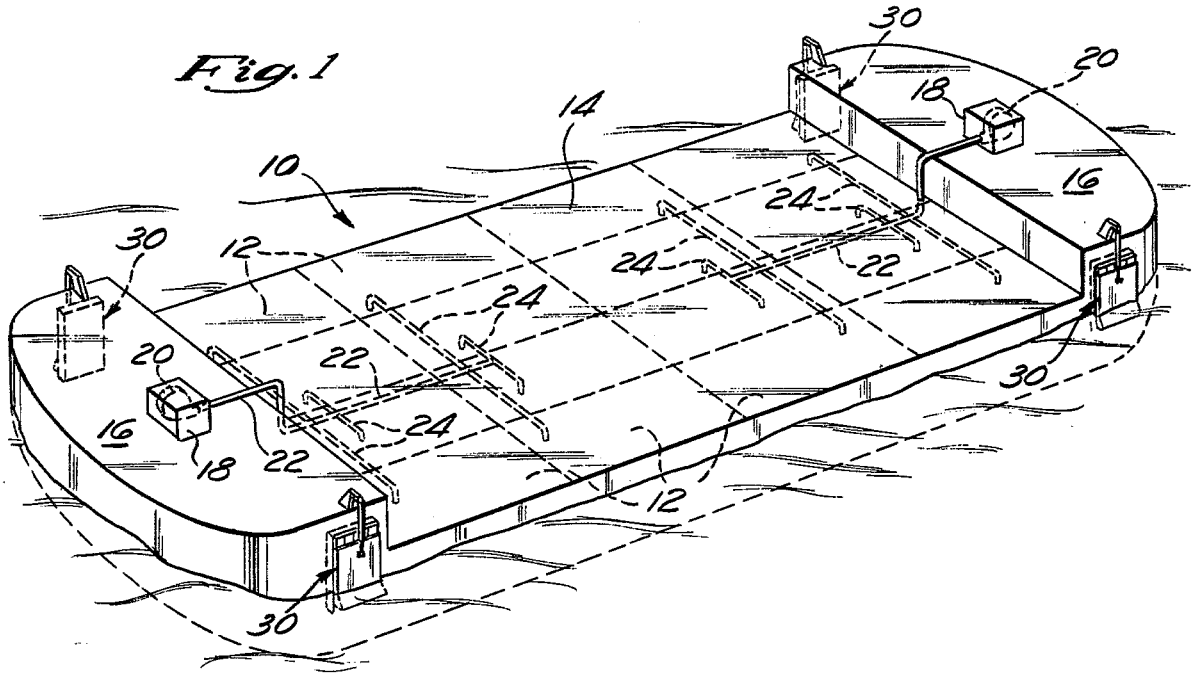
FIG. 1 is a perspective view of a submersible barge incorporating a ballast control system in accordance with the present invention.

A submersible vessel such as a barge 10 has a plurality of floodable ballast tanks or compartments 12 underlying a deck 14 on which cargo is carried. At each end of the barge 10 is a superstructure 16 which may contain storage areas for equipment and machinery needed to operate the barge, as well as non-floodable flotation compartments.

Located on each of the superstructures 16 is a pump housing 18 containing a reversible air pump 20. Each of the ballast compartments 12 is served by the closer of the two air pumps 18 through an air conduit system comprising a main conduit 22 and branch conduits 24.

Figure 2:
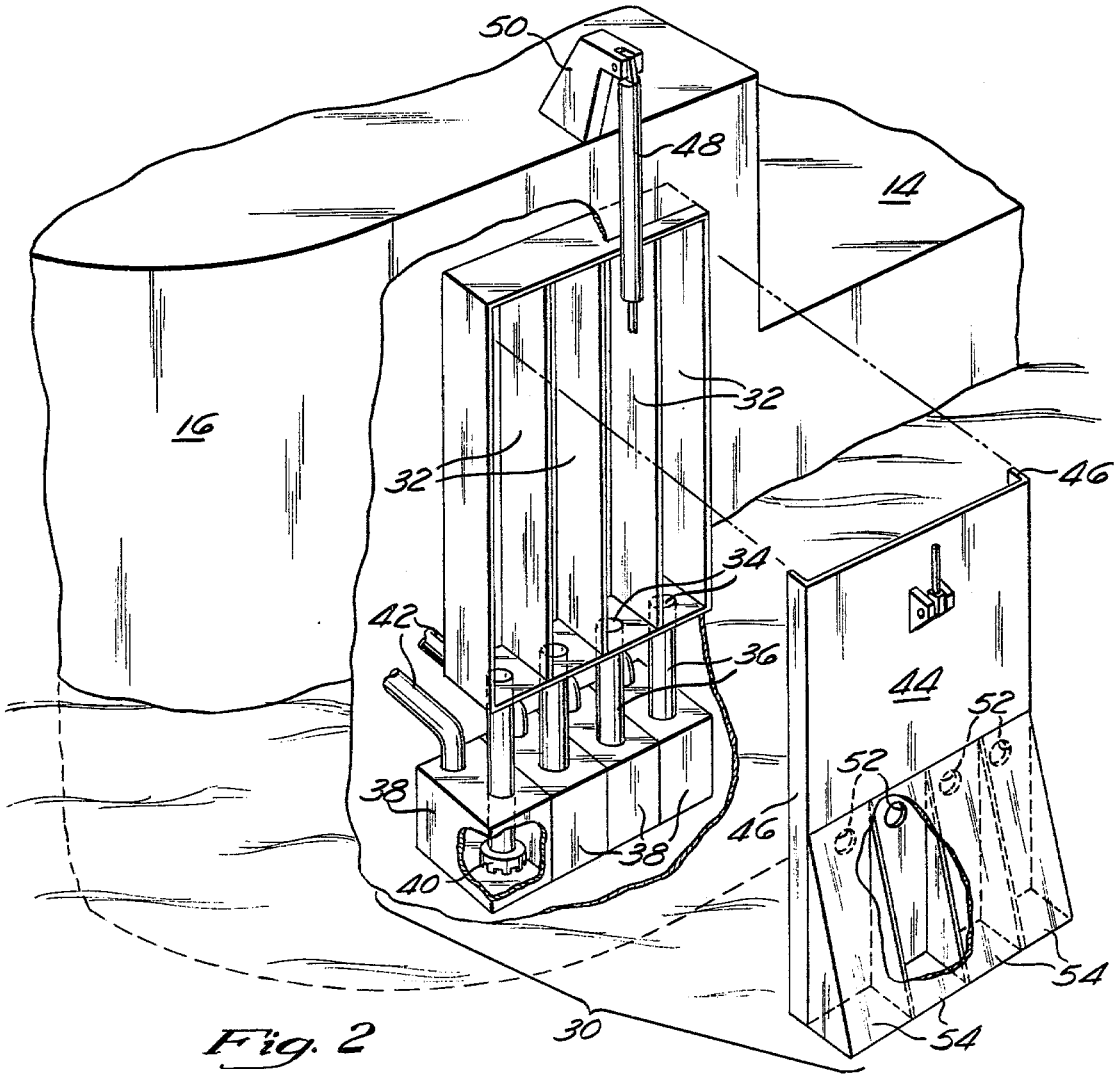
FIG. 2 is a detailed perspective view, partially broken away, of the water inlet and outlet mechanism used in the present invention.

At each corner of the vessel on opposite sides of each of the superstructure 16 is a water inlet and outlet mechanism 30, one of which is illustrated in detail in FIG. 2. Each of the inlet/outlet mechanisms 30 serves one quadrant of the barge, each quadrant containing one quarter of the total number of ballast compartments. Thus, each of the inlet/outlet mechanisms will serve the number of compartments 12 in the closest quadrant of the barge. In the specific example illustrated in FIG. 1, there are 16 ballast compartments, and, therefore, each quadrant of the barge will contain four compartments. Accordingly, each of the inlet/outlet mechanisms must be designed to serve the four compartments in the nearest quadrant.

Turning now to the structure illustrated in FIG. 2, it is seen that each of the inlet/outlet mechanisms 30 comprises four vertical chambers 32, one for each of the compartments 12 served by the inlet/outlet mechanisms 30. The chambers 32 are preferably square or rectangular in cross-section and are enclosed on all sides but the front or outwardly facing side. Each of the chambers 32 has an opening 34 in the bottom thereof which communicates with a short vertical conduit or riser 36. The risers 36 each extend downwardly into an enclosure or reservoir 38, terminating in a collar 40 having openings for the passage of water. Each of the enclosures 38 communicates with the interior of the ballast tank via a pipe 42.

The vertical chambers 32 are opened to the exterior of the barge and are covered by a gate 44. The gate 44 has a pair of inwardly extending flanges 46 along the sides thereof which slidably engage the side walls of the two end chambers 32, which side walls extend outwardly through the hull of the barge. The gate 44 is moved up and down along said side walls by a hydraulic cylinder 48 suspended from an arm 50 mounted on the superstructure 16 of the bare. It will be readily appreciated that, as a result of the aforesaid action of the gate 44, the vertical chambers 32 become, in effect, sealable, height-adjustable risers, the top of the gate 44 providing a threshold (FIG. 4) for the outflow of water, as will be presently described.

Arranged across the gate 44 a short distance above the bottom edge thereof are four inlet ports 52, each of which communicates with the interior of an inlet conduit 54. The inlet conduits 54 are preferably triangular in configuration and are open at the bottom.

Its structure having been fully described, the invention's manner of operation will now be readily understood.

As previously mentioned, submersible barges are typically loaded and unloaded by submerging the vessel until the cargo carrying deck is awash, and then floating the cargo on or off the deck. While in the prior art it is typical to submerge only one end of the barge, thus creating a potentially unstable situation, with the present invention, submergence of the entire barge to a predetermined depth is facilitated and is, therefore, preferred.

The description of the submerging operation is made with specific reference to FIGS. 2 and 3. As shown in FIG. 3, submerging is accomplished by raising the gate 44 to its uppermost position so that the chambers 32 are completely sealed. The reversible air pumps 20 are then actuated to evacuate air from the compartments 12 via the air conduits 22 and 24. As air is drawn from the compartments 12, a negative pressure is applied to the water conduits 42 (see FIGS. 5 and 6) and this negative pressure is applied to the fixed risers 36 via the reservoir enclosures 38.

With the gates 44 raised so as to be in the closed position shown in FIG. 3, the water inlet ports 52 communicate with the interior of the rectangular chambers 32 so that the suction applied to the fixed length risers 36 is likewise applied to the triangular conduits 54 at the bottom of the gates 44 through the openings 34 by which the fixed length risers 36 communicate with the vertical chambers 32. Since the open bottoms of the triangular conduits 54 are located below the unloaded water line of the vessel, and thus below the surface of the water, and since the negative pressure applied by the pumps 20 is sufficient to lift the water up to the height of the inlet ports 52, water will be drawn into the vertical chambers 32, through the inlet ports 52, and then down through the fixed height risers 36 into the chambers 38, and then through the pipes 42 into the compartments 12. In this manner the compartments 12 are flooded in response to the application of a negative pressure. This process continues until the compartments 12 are flooded sufficiently to submerge the vessel to the desired depth.

Figure 5:
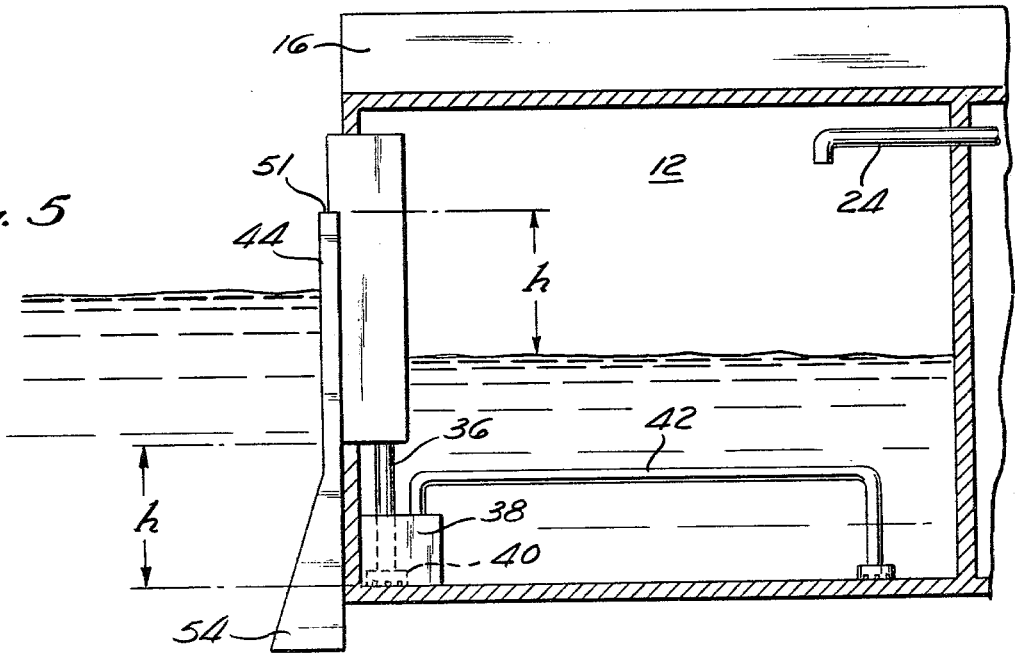
FIG. 5 is a schematic representation of a vessel incorporating the present invention, illustrating the dewatering operation for raising the vessel.

The raising operation will best be understood with reference to FIGS. 2, 4 and 5. For deballasting (dewatering), the gates 44 are lowered as shown in FIG. 4 so that the upper portions of the rectangular vertical chambers 32 are opened to the exterior of the vessel. The air pumps 20 are reversed so as to supply a positive air pressure to the compartments 12, causing the water contained therein to be evacuated through the pipes 32, into the reservoirs 38, up the risers 36, and into the chambers 32 from which the water leaves the vessel over the tops of the gates 44.

The air pumps are set to deliver a constant positive pressure which is sufficient to raise a head of water just slightly less than the height of the fixed risers 36, i.e., from the entrance openings in the collars 42 to just below the openings 34 in the bottom of the vertical chambers 32. Referring to FIG. 5, this height is labeled "h". Therefore, in order to evacuate the water from the ballast tanks, the gates 44 must be lowered so that the threshold 51 offered by the tops of the gates is at a height above the surface of the water in the ballast tanks which is slightly less than the height "h". Thus, the height of the threshold 51 ("threshold height") will be such as to allow water to be evacuated using the aforementioned preset pressure which is set at a value sufficient to lift a column of water the height "h".

As the ballast tanks are evacuated, the water level therein drops. In order to keep the thresholds 51 at the proper height above the mean level of the water in the tanks, the gates 44 must be lowered as the vessel is being raised. This can be accomplished without fear that the thresholds 51 will go lower than the surface of the water external to the vessel since the actual water line of the vessel will be descending down the hull as the vessel rises. This process will continue until the thresholds 51 are approximately even with the level of the openings 34 at the top of the fixed height risers 36. At this point the water near the bottom of the ballast tanks will be evacuated, leaving the tanks substantially empty.

It will thus be appreciated that by causing the gates 44 to descend concurrently with the mean level of water in the ballast tanks, the vertical chambers 32 become, in effect, variable height risers, with a height which is adjusted downwardly to remain at a fixed level above the descending surface of the water in the ballast tanks. The principal advantage of such a system is that a relatively low constant pressure can be used to evacuate the water from the ballast tanks, inasmuch as if the risers were fixed at the initial height of the threshold 51, the pressure necessary to evacuate the water would either have to increase as the level of water in the tanks dropped, or would have to be initially set at a high enough pressure to raise the water from the bottom of the ballast tanks to the top of the risers. The ability to use a constant, relatively low pressure for the dewatering process eliminates the need for the re-enforcement of the vessel's structural members, which would be necessary if high pressure levels were used. Not only does this feature allow vessels which are built to incorporate the present invention to be made much more economically, but also it facilitates the retrofitting of existing vessels with the present invention without the necessity of substantial reconstruction.

The use of just sufficient pressure to raise water the height "h" slightly less than the height of the fixed height risers 36 also serves to prevent air from escaping from an empty ballast tank in the event that one or more of the tanks are evacuated while other tanks are still being emptied. Such an escape of air would, of course, result in a loss of pressure in those tanks being served by the same pump as the empty tank or tanks, thus bringing the dewatering process to a halt for those tanks. The prevention of such an escape of air is accomplished in the following manner:

When one of the ballast tanks 12 becomes emptied, the water conduit 42 connecting that tank to its associated inlet/outlet mechanism 30 will start delivering air to the enclosed water reservoir 38 to which the conduit 42 is connected. At this point the water in the reservoir 38 will start to be evacuated, causing the water level in the water reservoir 38 to drop. Since the height "h" of the column of water which can be lifted by the pressure delivered to the reservoir 38 is less than the height of the fixed height riser 36, once the level of water in the reservoir 38 drops to a distance below the top of the riser 36 which is greater than the height "h", the pressure delivered to the reservoir 38 will be insufficient to lift the water to the riser openings 34. Consequently, as long as pressure is applied to the reservoir 38 there will be column of water in the riser 36 which blocks the path of escape for the air. When the pressure is turned off, the column of water in the riser will naturally fall to the bottom of the reservoir where it will be available, when pressure is once again applied, to block the path of escaping air by remaining in the riser. Thus, by providing means for automatically preventing the escape of air from an empty ballast compartment, the dewatering of the remaining compartments can continue without requiring a complex valving system, which would have to be closely monitored, for blocking the flow of air into and/or out of the empty compartments.

Figure 7:
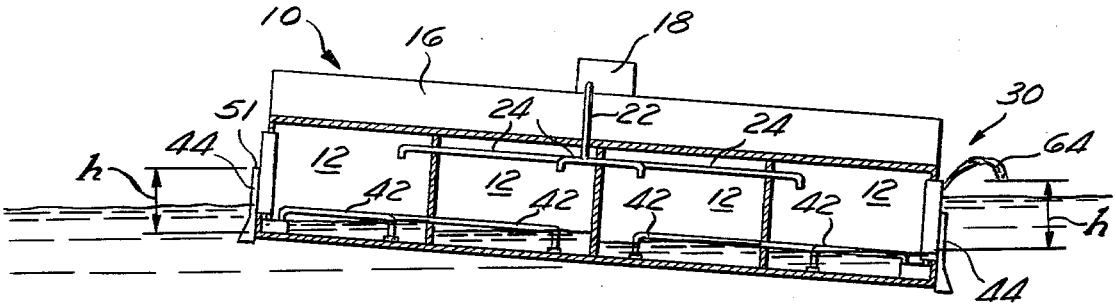
FIGS. 6 and 7 are schematic representations illustrating the self-leveling feature of the present invention.
Figure 6:
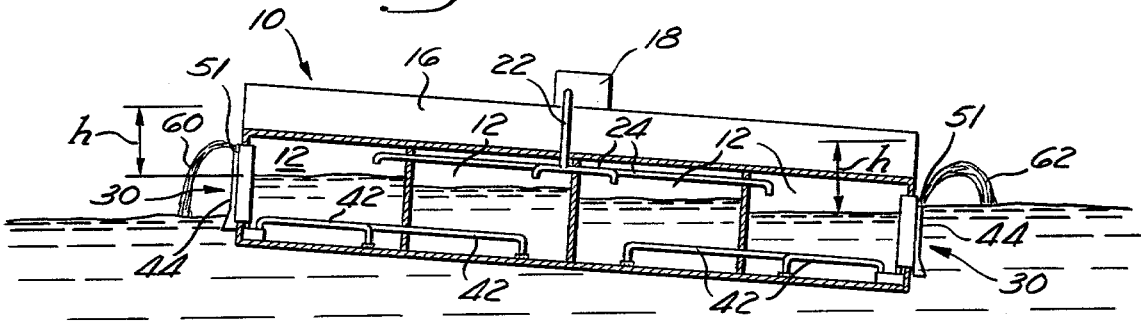

The ability of a vessel constructed in accordance with the present invention automatically to level itself during the raising process is illustrated in FIGS. 6 and 7. Referring first to FIG. 6, the vessel is shown as inclined or tipped laterally so that the right side is more deeply submerged than the left side. During the initial stages of the raising process, the ballast compartments 12 are nearly full. Since the thresholds 51 of the gates 44 on both sides of the vessel are less than the height "h" above the surface of the water contained in the ballast compartments respectively served by the inlet/outlet mechanisms 30 on each side of the vessel, water will be expelled at both sides of the vessel as shown by the dashed lines 60 on the left and 62 on the right. However, with all of the gates 44 on the vessel being lowered the same amount so that the heights of all the thresholds 51 are at the same level with respect to the hull of the vessel, the tipping of the vessel causes the surface level of the water contained in the compartments on the more deeply submerged side of the vessel to be at a higher level with respect to the thresholds 51 than is the surface of the water in the compartments on the less deeply submerged side. Thus, a head differential is set up between the more deeply submerged side and the less deeply submerged side, such that the water contained in the more deeply submerged compartments must be lifted a lesser height to be evacuated than does the water in the less deeply submerged compartments. Given that an equal air pressure is delivered to all compartments, the result is that the water is evacuated more rapidly from the more deeply submerged compartments than it is from the less deeply submerged compartments until the vessel achieves a level attitude.

Similarly, as shown in FIG. 7, the self-leveling characteristics provided by the invention operate near the end of the raising process when the ballast compartments 12 are nearly empty. In this case, the tipping of the vessel causes the water level in the ballast tanks 12 on the less deeply submerged side of the vessel to be a distance greater than the height "h" below the level of the thresholds 51 so that no water can be evacuated therefrom. However, the water in the compartments on the more deeply submerged side of the vessel is at a distance below the height of the thresholds 51 which is less than the height "h", so that water can be evacuated therefrom as shown by the dashed lines 64 on the right side of FIG. 7. Thus, water will be evacuated from the more deeply submerged side of the vessel until the vessel is in a level attitude.

Thus, it will be seen that the invention provides automatic leveling of the vessel without the need for any additional controls and without the need for complex valving or monitoring systems. As long as the heights of all the thresholds 51 are at the same level with respect to the hull, and as long as an equal air pressure is delivered to all compartments, the vessel will automatically self-compensate for any deviation from a level attitude. Moreover, it will be readily appreciated that the invention will not only compensate for lateral or side-to-side tipping, but also for longitudinal or end-to-end tipping, or any combination of the two. It will also be appreciated that should the vessel assume a non-level attitude during the submerging procedure, all that must be done to recover a level attitude is to halt temporarily the submerging process and initiate the raising procedure for the relatively short time needed to level the vessel.

Thus, it will be seen that a vessel constructed in accordance with the present invention provides several significant advantages:

(a) Absolute stability is automatically maintained throughout the raising and submerging process.

(b) The need for valves in the air flow and water flow systems has been completely eliminated.

(c) The machinery needed for raising and submerging the vessel is minimized, thereby providing additional space for cargo storage and crew quarters, and, if the vessel is self-propelled, for propulsion equipment and fuel storage.

(d) Submerging and raising is accomplished with very low air pressures (i.e., as low as 4 psi), thereby eliminating the need for reinforced structural members such as would be needed to accommodate high pressure systems.

(e) The simplicity of operation and the self-leveling characteristics of the invention allow the vessel to be submerged, loaded or unloaded, and raised in a fraction of the time currently necessary, and with a much higher degree of safety than is currently obtainable.

(f) Only two controls are needed for operation of the vessel, i.e., means for changing the air pumps from negative to positive pressure, and means for controlling the hydraulic mechanism which raises and lowers gates. Both types of controls are conventional and well known in the art.

By way of specific example, it is contemplated that a vessel having deck dimensions of 500 feet by 240 feet would have a hull depth of 30 feet which would include a 4 foot deck. Sixteen ballast compartments would be provided, each 125 feet by 60 feet, and each of the four inlet/outlet mechanisms would thus serve the four ballast compartments in the nearest quadrant of the vessel. The two reversible air pumps would each be 400 horse power units having a capacity of 1800 cubic feet per minute at four pounds per square inch, either positive or negative pressure. With these dimensions the vessel would be capable of holding 2,400,000 cubic feet of ballast and would have a loaded draft of 10 feet, with the deck capable of submerging as much as 20 feet. With the air pumps as previously described, complete deballasting to raise the vessel from its maximum submergence of 20 feet could take as little as 2 hours, and, of course, the raising could be accomplished even in such a short time with minimal risk of capsizing.

What is claimed is:

1. In a submersible vessel, of the type having a hull and plural ballast compartments therein, and means for filling said compartments with water and evacuating water from said compartments by the application of predetermined negative and positive air pressure, respectively, the improvement comprising:

first means for conducting water from said ballast compartments to the exterior of said vessel through an outlet in response to said positive air pressure; and second means for maintaining said outlet at a constant height above the level of water in said ballast compartments as said ballast compartments are evacuated, so that said predetermined positive air pressure can be held constant at a value sufficient to lift water to a height equal to or slightly greater than said constant height.

2. The vessel of claim 1, wherein said first means comprises a plurality of vertical risers, each having an upper opening forming said outlet and a lower opening in communicating with one of said ballast compartments, and said second means comprises vertically movable means associated with said risers for adjusting the height of said upper opening with respect to said hull as water is evacuated from said ballast compartments.

3. The vessel of claim 2, wherein said vertically movable means is movable between upper and lower extremes of travel, and includes means for providing a water inlet into said risers when said vertically movable means is at said upper extreme of travel, said water inlet being closed as said vertically movable means descends from said upper extreme of travel.

4. The vessel of claim 3, wherein each of said ballast compartments is in communication with one of said risers located at the corner of said vessel nearest said compartment, said risers each comprise a vertical tubular member communicating with an elongate vertical opening in the side of said hull and forming said riser upper opening, and said vertically movable means comprises a gate movable along the exterior of said hull at each corner thereof so as to (a) seal said vertical openings and provide said water inlet from the exterior of said vessel into said tubular members when at said upper extreme of travel, and (b) open at least a portion of said vertical openings and close said water inlet as said gate descends from said upper extreme of travel.

5. The vessel of claim 4, wherein said gate has an upper edge, the movement of which with respect to said vertical openings provides said constant height of said water outlet above the level of water in said ballast compartments.

6. The vessel of claim 2, further comprising:

third means for allowing water to be evacuated more quickly from more deeply submerged ballast compartments than from less deeply submerged ballast compartments in response to said predetermined positive air pressure when said vessel is tilted while it is being raised, so that said vessel is automatically stabilized in a substantially level attitude.

7. The vessel of claim 6, wherein each of said ballast compartments is in communication with one of said risers located at the corner of said vessel nearest said compartment, and said third means comprises water head differential means for providing a lesser height in said risers for the water in the more deeply submerged of said compartments to be lifted for evacuation in response to said predetermined positive air pressure than the height for which the water in the less deeply submerged compartments must be lifted to be thus evacuated, so that, in response to an equal positive air pressure delivered to all of said compartments, water will be evacuated more quickly from the more deeply submerged compartments than from the less deeply submerged compartments until said vessel achieves a substantially level attitude.

8. The vessel of claim 4, wherein said tubular members have a height approximately equal to, or slightly greater than, said constant height.

9. In a submersible vessel, of the type having a hull containing plural ballast compartments, a system for controlling the flow of water into and out of said ballast compartments in response to predetermined negative and positive air pressures, respectively, to submerge and raise said vessel, wherein said system comprises:

first means for selectively applying said predetermined negative and positive air pressures equally to all of said compartments;

second means, in fluid communication with each of said compartments, for conducting water therefrom to the exterior of said vessel in response to said predetermined positive air pressure, said second means including risers located on opposite sides of each end of said hull, each of said compartments being in fluid communication with the nearest of said risers, each of said risers terminating in an outlet opening located above the loaded water line of said vessel;

a water inlet opening in said hull below each of said outlet openings, each of said compartments being in fluid communication with the nearest of said inlet openings;

plural gating assemblies movable vertically on the exterior of said hull, one of said gating assemblies located at each of said opposite sides of said hull at each end thereof, said gating assemblies each being movable to an upper position to seal said outlet openings and open said inlet openings, and movable downwardly from said upper position to seal said inlet openings and open said outlet openings; and conduit means in said gating assemblies for fluid communication between said inlet openings and the water external to said vessel when said gating assemblies are in said upward position; and said gating assemblies thereby providing a path for water to enter said compartments through said conduit means and said inlet openings in response to the applications of a negative pressure to said compartments when said gating assemblies are in said upward position, and a path for water to be evacuated from said compartments through said outlet openings in response to the application of a positive pressure to said compartments when said gating assemblies are moved downwardly from said upper position.

10. The vessel of claim 9, wherein said outlet openings are elongate vertical openings, said risers each include a vertical tubular member communicting with the bottom of one of said vertical openings, and said gating assemblies are vertically movable to present a threshold at varying heights on said vertical openings, so that said vertical openings each provide a variable height riser in combination with one of said vertical tubular members.

11. The vessel of claim 10, wherein said vertical tubular members have a height approximately equal to, or slightly less than, a height "h" of a column of water which would be raised by said predetermined positive air pressure.

12. The vessel of claim 11, wherein said gating assemblies are adapted for uniform adjustment downwardly from said upper position as said ballast compartments are evacuated, so that the height of each of said variable height risers is maintained approximately equal to, or slightly less than, said height "h" above the mean water level in the ballast compartment with which said riser is in fluid communication.

13. A method of operating a submersible vessel, of the type having a deck and a plurality of ballast compartments in the hull thereof, said method comprising the steps of:

(1) drawing water into said ballast compartments from the exterior of said vessel through inlet ports in said hull in response to the application of a negative air pressure to said ballast compartments to submerge the deck of said vessel;

(2) sealing said inlet ports and ceasing the application of said negative air pressure;

(3) opening a plurality of outlet ports located at a specified height in said hull;

(4) applying a constant value positive air pressure equally to all of said ballast compartments to evacuate water therefrom through said outlet ports, said positive air pressure being approximately equal to, or slightly greater than the pressure needed to lift a column of water a height equal to the height of said outlet ports above the mean water level in said compartments; and (5) as said compartments are evacuated, lowering the height of said outlet ports to maintain said outlet ports at a substantially constant height above the mean water level in said compartments, so that said positive air pressure can be maintained at said constant value to continue the evacuation of said compartments and thereby raise said vessel.

14. The method of claim 13, wherein said outlet ports are elongate vertically, and the height of said outlet ports is lowered by vertically moving a gating member downwardly along said outlet ports.

15. The method of claim 14, wherein said gating member has an upper position and a lower position, wherein said gating member seals said outlet ports and opens said inlet ports when in said upper position, and seals said inlet port and opens said outlet ports as said gating member moves toward said lower position.

16. The method of claim 15, wherein said water is drawn into said ballast compartments through a conduit in said gating member, said conduit extending below the water line of said vessel and communicating with at least one of said inlet ports when said gating members are in said upper position.

17. The method of claim 13, wherein a plurality of said outlet ports are located on opposite sides of said hull at each end thereof, and said ballast compartments are each in communication with one of said outlet ports at a location nearest to said compartment, and wherein said method further comprises the step of:

(6) keeping all of said outlets at a uniform height with respect to said hull while applying equal pressure to all of said compartments when said vessel is in a non-level attitude, so that water is evacuated more quickly from the more deeply submerged of said compartments than from the less deeply submerged of said compartments, until said vessel attains a substantially level attitude.

18. The method of claim 13, wherein said constant value of said positive pressure is less than ten pounds per square inch.

* * * * *